US012529197B2

(12) United States Patent
Ayers

(10) Patent No.: US 12,529,197 B2
(45) Date of Patent: Jan. 20, 2026

(54) TERRAPIN SYSTEM

(71) Applicant: Ryan Ayers, Sandyston, NJ (US)

(72) Inventor: Ryan Ayers, Sandyston, NJ (US)

(73) Assignee: FASTEPC, INC., Jacksonville, FL (US)

( * ) Notice: Subject to any disclaimer, the term of this patent is extended or adjusted under 35 U.S.C. 154(b) by 393 days.

(21) Appl. No.: 17/931,924

(22) Filed: Sep. 14, 2022

(65) Prior Publication Data

US 2024/0084538 A1 Mar. 14, 2024

(51) Int. Cl.
*E02D 3/08* (2006.01)

(52) U.S. Cl.
CPC ..... *E02D 3/08* (2013.01)

(58) Field of Classification Search
CPC ..... E02D 5/54; E02D 5/805; E02D 3/08
See application file for complete search history.

(56) References Cited

U.S. PATENT DOCUMENTS 2,396,276 A * 3/1946 Lang ..... E02D 5/805 411/922
2,723,733 A * 11/1955 Petersen ..... E02D 5/805 52/160
3,056,477 A * 10/1962 Wooley ..... E02D 5/805 29/239
3,187,858 A * 6/1965 Des Champs ..... E02D 5/54 52/160
3,526,069 A * 9/1970 Deike ..... E02D 5/805 405/244
3,676,965 A * 7/1972 Deike ..... E04H 12/2284 52/157
3,772,838 A * 11/1973 Virnig ..... E02D 5/805 52/DIG. 11
3,855,745 A * 12/1974 Patterson ..... E02D 5/805 405/253
3,861,097 A * 1/1975 Patterson ..... E02D 5/805 52/160
4,086,735 A * 5/1978 Adams ..... E02D 5/805 405/259.1
5,010,698 A * 4/1991 Hugron ..... E02D 5/805 135/118
5,217,194 A * 6/1993 Brownell ..... E04H 12/223 411/359
5,765,321 A * 6/1998 Barbera ..... E04H 12/223 52/155
6,047,505 A * 4/2000 Willow ..... E02D 5/54 405/253
9,062,431 B2 * 6/2015 Koehler ..... E02D 3/054
10,640,945 B1 * 5/2020 Niroumand ..... E02D 5/44
2013/0051927 A1 * 2/2013 Kruse ..... E02D 27/32 405/232
2019/0249388 A1 * 8/2019 Hinojosa ..... E02D 5/801

FOREIGN PATENT DOCUMENTS

CN 102162246 A * 8/2011

* cited by examiner

*Primary Examiner* — Edwin J Toledo-Duran
(74) *Attorney, Agent, or Firm* — The Webb Law Firm

(57) ABSTRACT

The invention relates to a terrapin for installing a pipe foundation and works by sandwiching soil for final pin placement. The terrapin is a system used to strengthen unconfined soil layers. The terrapin dramatically reduces the potential for project site disruption by creating a sandwich of the soil layers to strengthen the soil properties during pin placement and installing a casing.

5 Claims, 8 Drawing Sheets

TERRAPIN SYSTEM

FIELD OF THE INVENTION

The invention relates to a terrapin for installing a pipe foundation and works by sandwiching soil for final pin placement.

BACKGROUND

Soil borings are extracted and reviewed by geotechnical engineers to provide recommendations on various piling designs. Six inch diameter soil borings are extracted by coring or drilling. Soil samples are collected from the extracted materials and preserved intact. The excess waste is returned to the subsurface. The samples that have been collected are analyzed to determine multiple parameters within the soil. The parameters include liquid, elasticity, composition, cohesiveness and gamma. The parameters are further classified into one foot layers. Each layer may consist of a variety or any combination thereof; clay, sand, silt, fill, gravel, or rock. This classification is further subdivided into loose or dense materials. The possibilities of combinations are endless. The soil borings, as determined by human interpretation and supported by computer generated algorithms to provide recommendations on various piling designs. Civil and structural engineers use these recommendations along with the recommendations on performance criteria to the supported member to finalize a piling design. However, the traditional piling design will exceed the diameter of the soil boring by two, five or even by ten times. This diameter differential is so great that it allows for the likelihood of project site disruptions due to unforeseen subsurface materials

SUMMARY OF THE INVENTION

The terrapin is a system used to strengthen unconfined soil layers. The terrapin dramatically reduces the potential for project site disruption by creating a sandwich of the soil layers to strengthen the soil properties during pin placement and installing a casing. By confining the soil layers a pin can be successfully placed in the sub-surface and remain plumb and casing remain secure. Where conventional pins or pilings require the removal of investigated geotechnical information, the terrapin sandwiches the soil layers with the casing. There are no spoil removals or pre-digging. Therefore, the soil is compacted to maximize its geotechnical properties.

SHORT DESCRIPTION OF FIGURES

DETAILED DESCRIPTION

All numbers and ranges used in the specification and claims are to be understood as being modified in all instances by the term "about". By "about" is meant plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. The ranges and/or ratios disclosed herein represent the average values over the specified range and/or ratio.

The term "includes" is synonymous with "comprises". "Below" in relation to the casing means the area underneath casing and the area towards the bottom end of the casing.

Materials used to construct the terrapin device can be any material sufficient for the purpose of achieving the function/purpose described herein. Casings are any conventional casings known in the industry to achieve the function/purpose described herein.

The specific features, sizes, and composition of the casing 4 and terrapin device 1 will be dependent on the soil conditions at the installation location and the foundational structure intended to be supported. The specific elements of the terrapin device 1 used to install the casing 4 will now be described.

Figure 1:
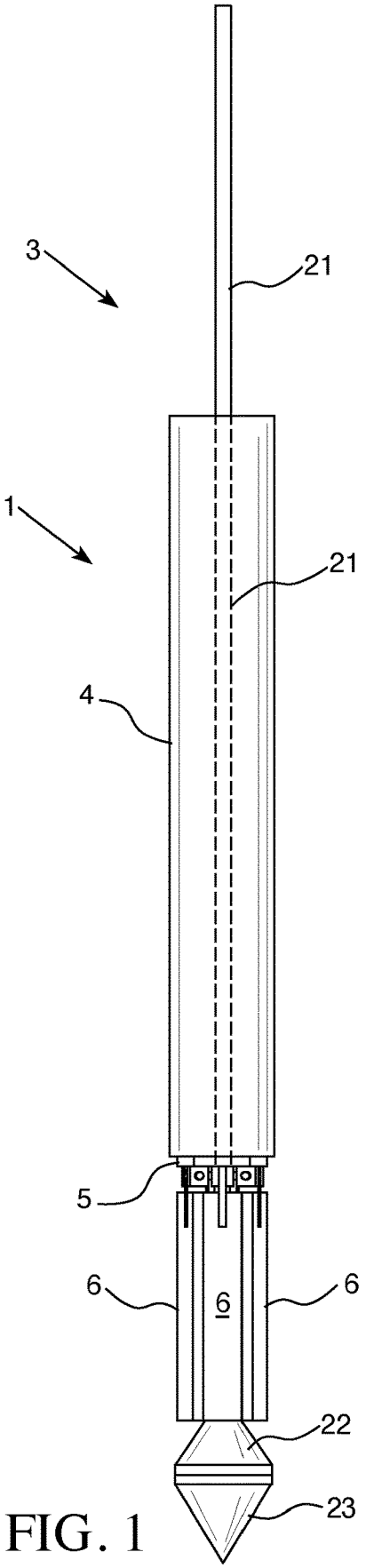
FIG. 1 shows side view of an embodiment of the terrapin system comprised of casing and compaction bar
Figure 2:
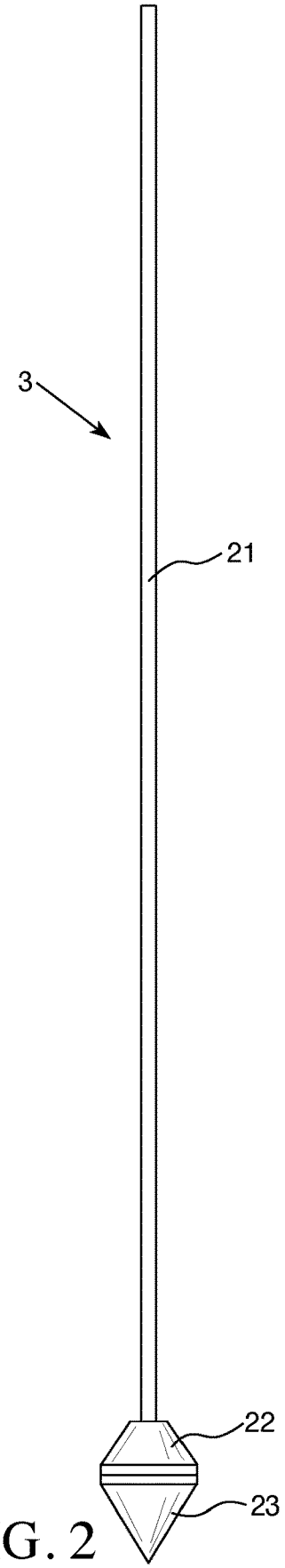
FIG. 2 shows side view of an embodiment of the compaction bar alone.
Figure 3A:
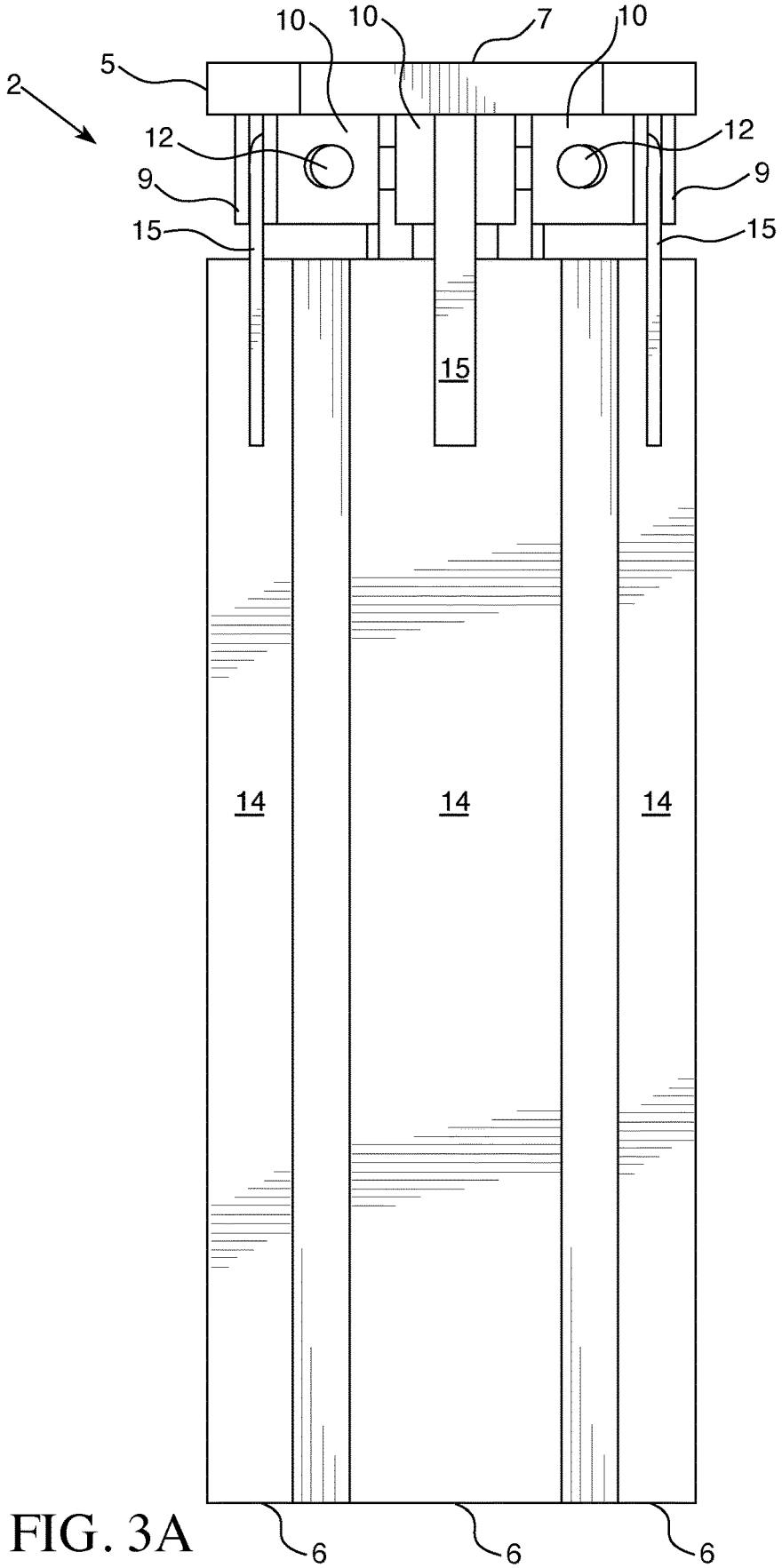
FIG. 3A shows side view of an embodiment of the swing system alone in collapsed configuration
Figure 3B:
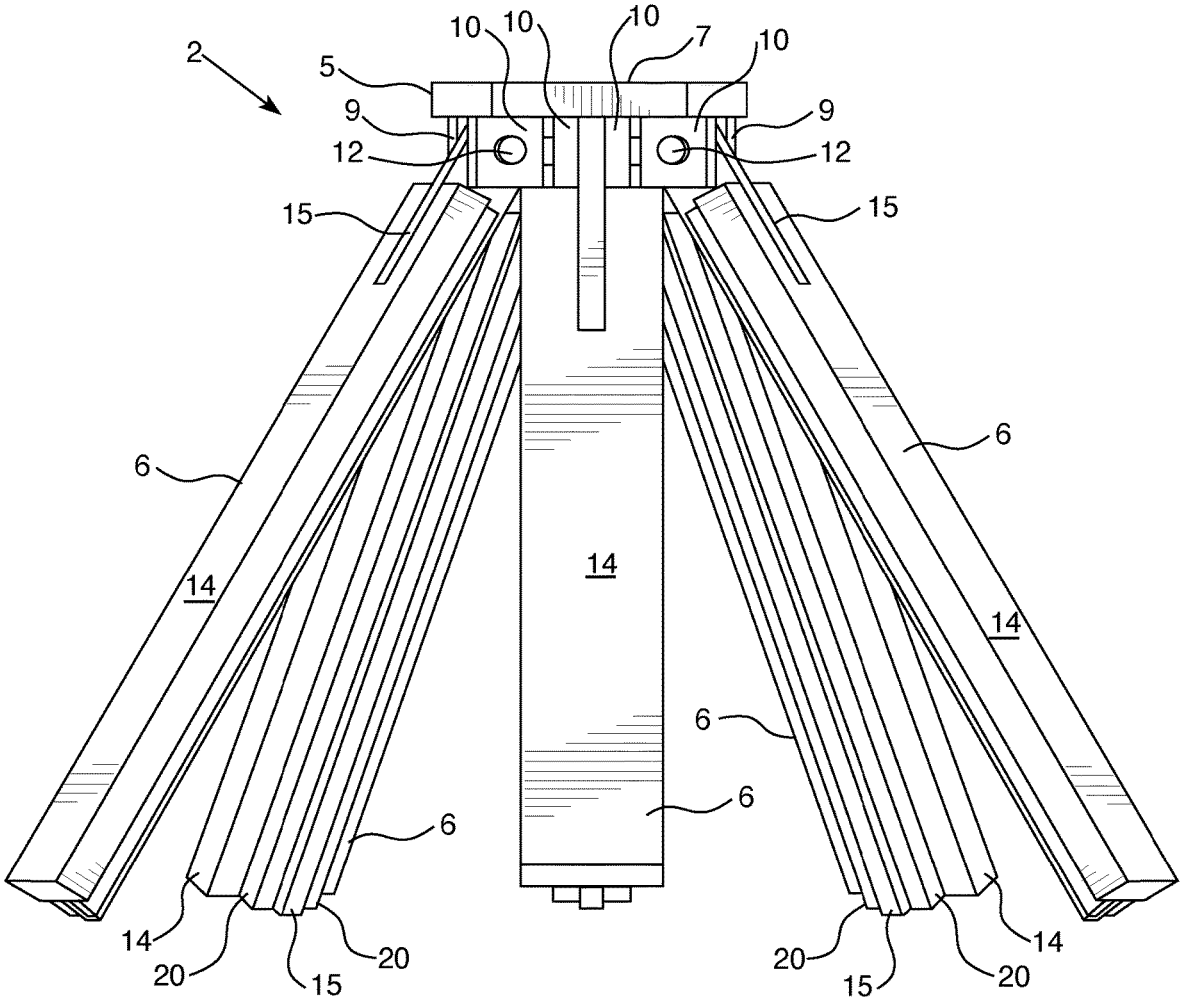
FIG. 3B shows side view of an embodiment of the swing system in extended configuration.
Figure 4A:
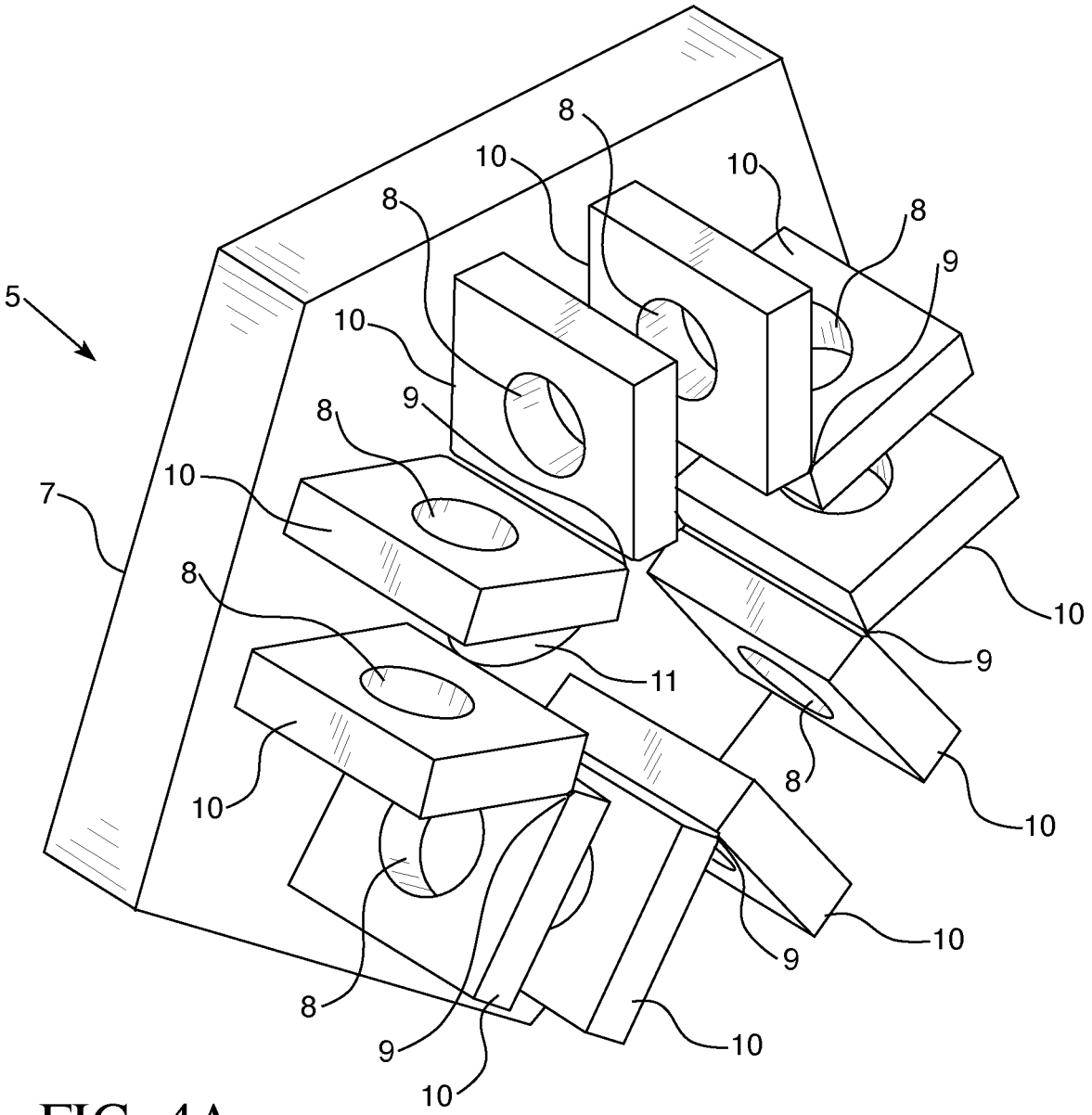
FIG. 4A shows a perspective view of an embodiment of the base plate.
Figure 4B:
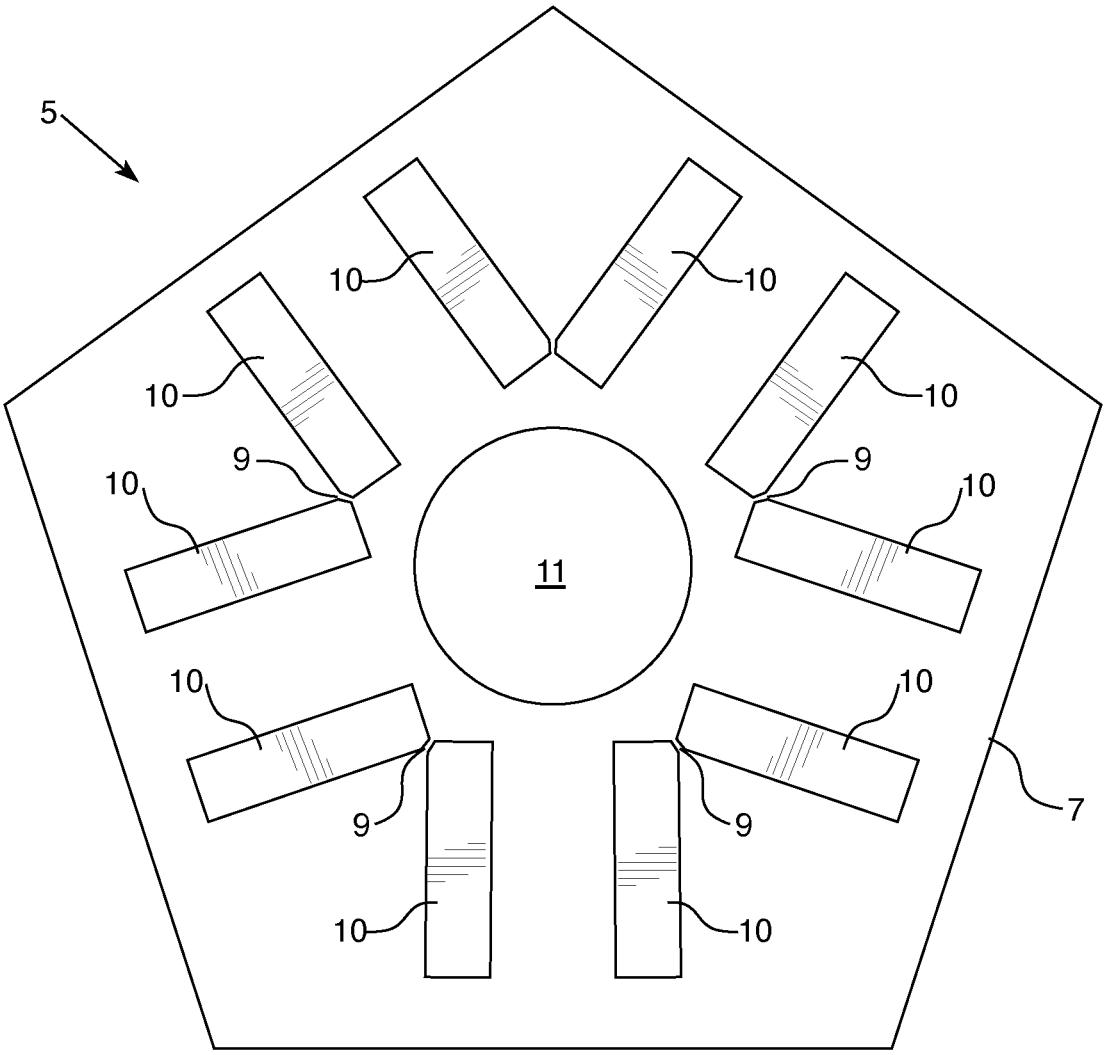
FIG. 4B shows the bottom view of an embodiment of the base plate.

The terrapin device 1 itself is comprised of a swing system 2 (non-limiting embodiment seen in FIGS. 3A/B) and a compaction bar 3 (non-limiting embodiment seen in FIG. 2) which works with a casing 4, assembled device as shown in the non-limiting embodiment in FIG. 1 The swing system 2 is comprised of a base plate 5 which holds a plurality of swinging members 6 capable of extending to a desired angle from their resting position. In some non-limiting embodiments, the range of the angle that swing members can extend is between 15-45 degrees, in some non-limiting embodiments, the desired angle will be about 30 degrees. The desired angle for any specific use will depend on soil conditions, and the structure and/or foundation the terrapin device will be supporting. The base plate 5 in some non-limiting embodiments and is as seen in FIGS. 4A-B is a pentagon shape while holding five swinging members 6 (FIGS. 3A/B). In some embodiments, the shape and number of swinging members may differ and any feasible shape and number of swinging members that will be achieve the function/purpose described herein is contemplated by this disclosure. Preferably the number of sides of the base plate equals the number of swinging members. The cross-sectional diameter of the base plate 5 should be of a size that allows the base plate 5 to fit inside of the casing 4 to be installed. The base plate 5 is comprised of a flat plate 7 with a centralized hole 11 and located on the bottom side of the flat plate 7 are a plurality of block pairs 9 with each individual block 10 having a hole 8 as the non-limiting embodiment in FIGS. 4A-B show, hole 8 being capable of receiving a pin 12. In the terrapin device 1 a pin 12 connects each block 10 of a block pair 9, and the pin 12 provides a means for the swinging members 6 to rotate while they are extending or collapsing. Though in the embodiment shown blocks 10 are shown as square blocks, in other embodiments, blocks 10 can be any feasible shape, including but not limited to having rounded corners or being completely rounded. This rotational design is a nonlimiting embodiment, any design that allows the swinging members to rotate to desired angle is contemplated by this disclosure. Alternatively, on the topside of base plate 5, may be lifting lugs (not shown) for use if the terrapin device 1 needs to be removed. Any conventional means knowns to those with skill in the art for removing the terrapin device is contemplated by this disclosure.

Figure 5A:
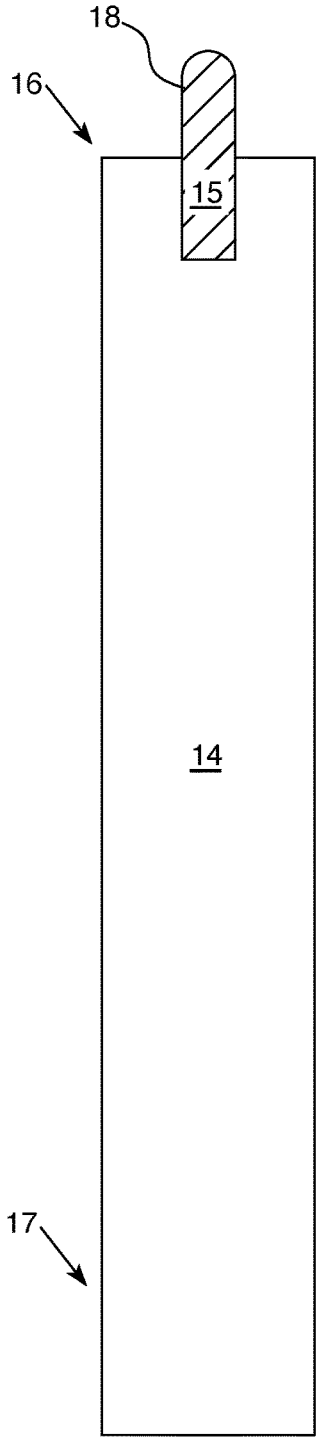
FIG. 5A shows the outer side view of an embodiment of a swinging member.
Figure 5B:
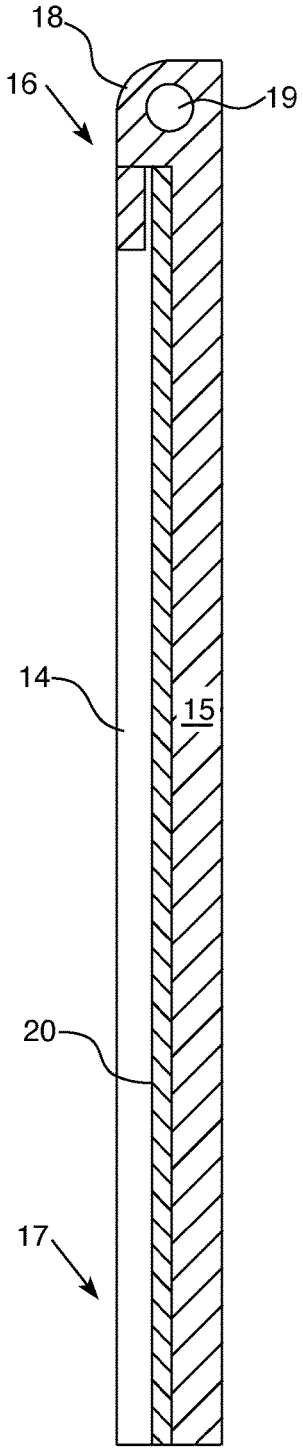
FIG. 5B shows the side view of an embodiment of a swinging member.
Figure 5C:
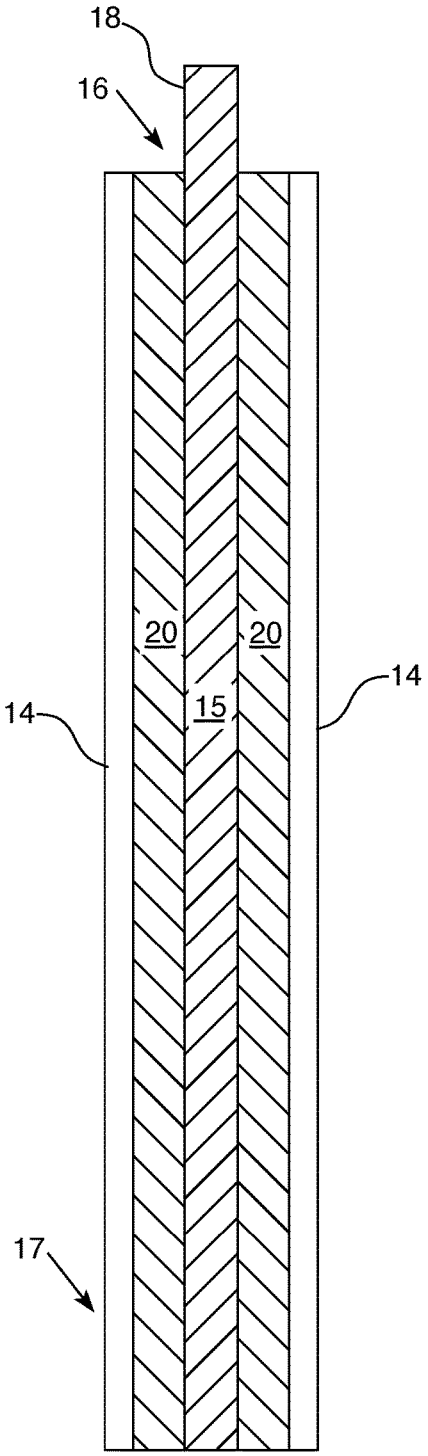
FIG. 5C shows the underside view of an embodiment of a swinging member.

As seen in FIGS. 5A-C, in some non-limiting embodiments, each swing member 6 is comprised of an outer piece 14 and a central piece 15 that is positioned on the underside of the outer piece 14 in the swing system 2 forming a steplike assembly. In some embodiments, the central piece 15 is comprised of a top end 16 and bottom end 17 and being comprised on its top end 16 is a partially rounded rotating section 18 with a hole 19 that can accommodate the pin 12 used with the blocks 10 of the base plate. Alternatively in some embodiments, the outer piece and central piece can comprise one solid piece. To further strengthen each swinging member as seen in FIGS. 5A-C as non-limiting embodiment, a piece of square bar stock 20 may be placed on either side of the perpendicular central piece 15, forming an additional step in the steplike assembly on the underside the swinging member. In some non-limiting embodiments, the underside of the swinging member can be a flat surface with only the corners beveled so that the swinging members can be placed in a fully closed position when resting on the cone.

Figure 6A:
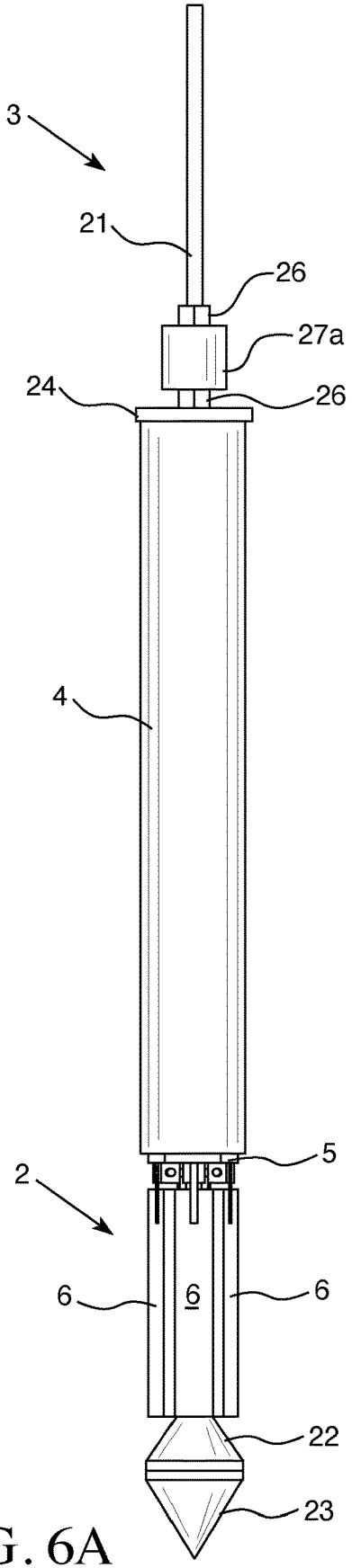
FIG. 6A shows an embodiment of the terrapin system in a collapsed configuration with an extension means in a closed configuration.

Further comprising the terrapin device in addition to the swing system is the compaction bar 3. The compaction bar 3 is comprised of a bar 21, a cone 22 and a driving pin 23. The bar 21 having a top end and a bottom end. The bottom end of bar 21 being connected to the cone 22 and the driving pin 23, the top end of bar 21 being of sufficient length that extends above the casing 4. The bar 21 is inserted through a hole 11 in the base plate 5 with a length that extends beyond the plurality of swinging members 6 sufficient to accommodate the cone 22 and the driving pin 23. In some non-limiting embodiments, the cone 22 includes a top surface hole (not shown) and a bottom surface hole that is large enough for the bar 21 to slide through freely into the driving pin 23 sitting below the cone 22, the interior of the driving pin 23 being a cavity (not shown) with an open top and being able to accommodate the bar 21 by any means known to those with skill in the art including but not limited to a threaded means to connect to the bar 21. Alternatively, in some non-limiting embodiments, the cone 22 and driving pin 23 be one piece with the bar 21 being affixed to the top surface cone 22 by any means known to those with skill in the art. In some non-limiting embodiments, the collapsed swinging members 6 rest on the cone 22 towards its top end as seen in FIG. 6A. As described below, when the cone 22 is raised upward, the cone 22 pushes against the swinging members 6 causing them to extend, see non-limiting embodiment in FIG. 6B. In some non-limiting embodiments, it may be advantageous to have bar 21 to be threaded along some areas of its length. In some non-limiting embodiments, bar 21 may be one piece of a certain length or may be made up of a plurality of pieces connected with couplers (not shown). Cone 22 can be any feasible shape with a lateral surface being at any angle that allows the swing members to extend to desired angle. Driving pin 23 can be any feasible shape with lateral surface being at any angle that allows for the function/purpose of the terrapin device 1.

Disclosed is a method and a system for using the terrapin for compacting soil while installing a casing. As a non-limiting embodiment:

Size of casing and terrapin will ultimately depend on specific project as generally known to those with skill in the art. A hole in the ground is drilled to a size and depth desired to accommodate the size of the casing to be used as a piling using any conventional means known to those in the art (not shown). The ultimate size of the casing 4 and terrapin device 1 will depend on the required capacity or the function necessary for a specific project. Embodiments including any feasible sizes, lengths, and widths necessary for typical projects in the industry are contemplated by this disclosure.

In some non-limiting embodiments, the casing 4 is inserted and aligned so that a space underneath the casing 4 can accommodate at least the length of the plurality of swinging members 6 attached to the base plate 5, plus the cone 22 and the driving pin 23. This allows the terrapin device 1 to be installed and expanded/deployed below the bottom of the casing. The terrapin device 1 is lowered through the casing via the compaction bar 3, if compaction bar 3 is not initially long enough to allow the base plate 5 to pass all the way through and be placed under the casing 4, bar 21 can be lengthened with additional pieces using couplers (not shown) until compaction bar 3 is extended all the way through the casing 4, such that a sufficient length of the bar 21 is exposed on over the casing 4 to allow for further manipulation for the installation process as will be described.

Figure 6B:
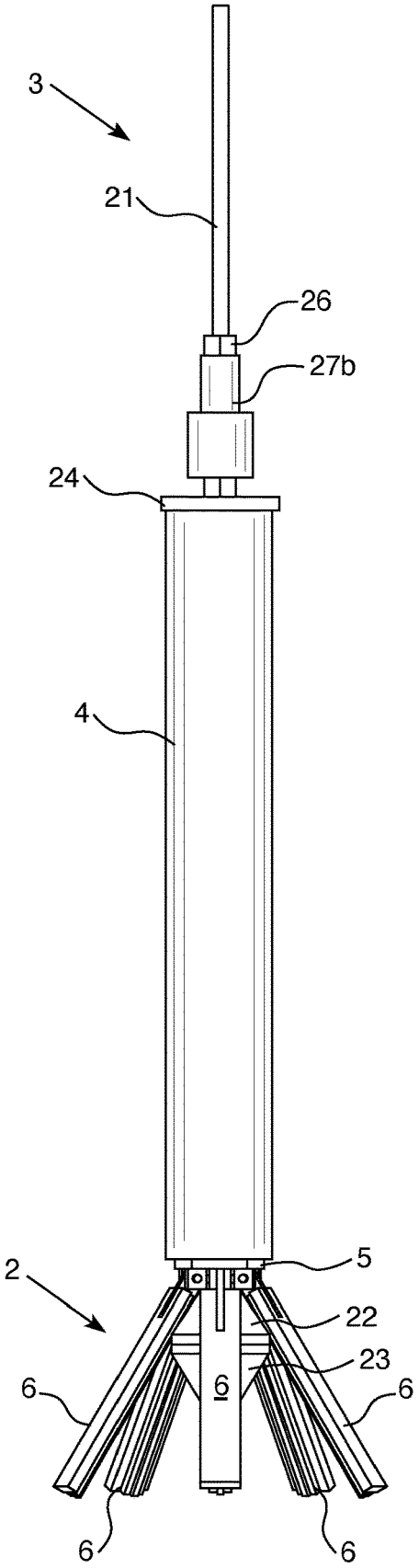
FIG. 6B shows an embodiment of the terrapin system in a extended configuration with an extension means in an open configuration.
Figure 7:
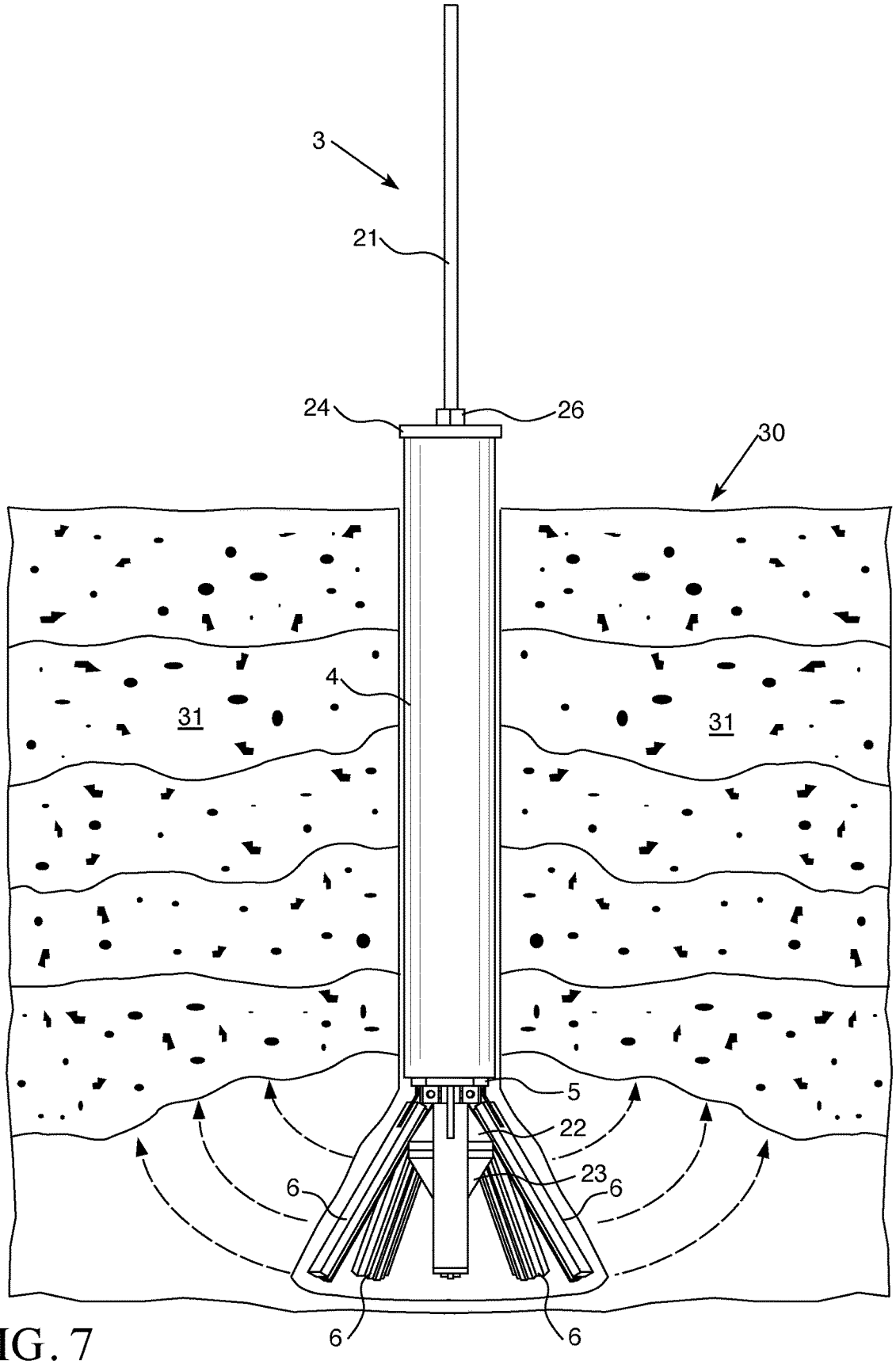
FIG. 7 shows an embodiment of the terrapin system when installed in the ground compacting soil layers.

In some embodiments, the casing 4 and compaction bar 3 can be configured to cooperate with an extension means 27*a/b* to allow for the swinging members 6 to extend below the casing 4 to compact the soil below the casing 4. In some non-limiting embodiments as shown in FIGS. 6A/B, other components such as a dish 24 and a securing means 26 are used for that cooperation. In some non-limiting embodiments, other configurations known to those with skill in the art that allow the casing and compaction bar to cooperate with the extension means to ultimately extend the swinging members 6 to the desired angle can be used. The shape of dish 24 can be any feasible shape and should be a size that will be larger in diameter than the casing 4 and the dish 24 having a hole large enough to allow the passage of the bar 21 to move freely through the hole. The dish 24 can be lowered over the top end of the bar 21 that is exposed above the casing 4 until it is sitting on the topside of the casing 4 and in some nonlimiting embodiments as shown in FIGS. 6A/B may be secured by a securing means 26, alternatively in other non-limiting embodiments, the extending means 27*a/b* may be lowered on the dish 24 without a securing means. In some non-limiting embodiments, the extending means in a closed configuration 27*a* is then lowered over the bar 21 until sitting on top of the dish 24. A securing means 26 is then lowered down to the extending means in a closed configuration 27*a* and tightened down to hold all components of with the exception of the compaction bar 3 which should move freely throughout terrapin device 1. As seen in FIG. 6B, upon activation, the extending means in an open configuration 27*b* is extended thereby causing the compaction bar 3 to be pulled up using the length of the bar 21 exposed above the casing 5, thereby pulling up/raising the cone 22/driving pin 23 upwards. This in turn forces the cone 22 up in between the plurality of swinging members 6 causing them to be deployed and/or extended outwards (see FIG. 6B), which in turn compacts and/or sandwiches the soil adjacent below casing 4. In one non-limiting embodiment, the extending means 27*a/b* may be a hydraulic jack cylinder, though any extending means known to those with skill in the art is contemplated by this disclosure. Depending on the stroke of the individual hydraulic jacking cylinder chosen, it may require repeating the extension/activation to allow the swinging members 6 to be fully deployed to desired angle. While using conventional means (not shown) and/or relying on the partially compacted ground to support the recently upward moved thread bar 21 in place, the securing means 26 is then removed, the extending means is set back to its closed configuration 27*a*, the securing means 26 is replaced and tighten again on the closed extending means 27*a* and the extension/activation is repeated. This can be done until the swinging members 6 are fully deployed/extended to the extent the cone can push them, or if using a hydraulic jack cylinder, the desired pressure in the cylinder is achieved for full deployment. In some non-limiting embodiments, when the swinging members 6 are in full deployment, the soil adjacent to the bottom of and below the casing 5 is compacted. When final upward movement/deployment is achieved the extending means 27*a/b* is removed and the securing means 26 is replaced directly on top of the dish 24 and tighten to manufacturers recommended torque spec against the dish, this locks the compaction bar 3 in place, thereby holding the driving pin 23 and cone 22 in place keeping the swinging members 6 extended. The terrapin device 1 is now installed/deployed. See the non-limiting embodiment in FIG. 7 showing terrapin device in ground 30 with soil layers 31 being compacted with the upward pressure (depicted by the arrows in the lowest soil layer) of the swinging members being expanded. In other embodiments, other means for securing the compaction bar to remain in extended configuration during deployment can be used.

Depending on its use, the terrapin device may only be temporary, and removal may be necessary. In a non-limiting embodiment of a mechanism for removal of the terrapin device, the means for securing the compaction bar is removed, for example, the securing means and the dish would be removed, then the compaction bar would be lowered without lowering the casing, thereby lowering the cone and driving pin causing the swinging members to collapse to a resting position, lifting up on the base plate via lifting lugs and removing terrapin device. Any feasible type of lifting lugs known to those with skill in the art is contemplated by this disclosure. Once the terrapin device is removed the casing is removed and the hole is backfilled until the hole is filled.

While specific embodiments of the terrapin device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the terrapin device of the present disclosure, which is to be given the full breadth of the claims appended and any and all equivalents thereof.

The invention claimed is:

1. A system for compacting soil in a hole comprising:

a terrapin configured for being removably inserted into the soil, said terrapin comprising a swing system and a compaction bar, the swing system being comprised of a base plate connected to a plurality of swinging members such that the swing members reversibly expand between a desired extension angle and a resting position while installed in the soil, said base plate having a centralized hole that accommodates the compaction bar allowing the compaction bar to move freely through, the compaction bar being comprised of a bar that is comprised of a top end and a bottom end, the bottom end being connected to a cone and a driving pin such that the cone sits above the driving pin and such that cone is in contact with the plurality of swinging members in their resting position;

whereby when a casing is placed in the hole, the terrapin is inserted by pushing the compaction bar through the casing such that the base plate, the plurality of swinging members, the cone and the driving pin are under the casing and the driving pin is contacting a bottom of the hole while a length of the bar to the top end remains above the casing, whereby the casing and the compaction bar are configured to cooperate with an extension member;

whereby when the extension member is extended in an open configuration, the compaction bar is pulled via the length of the bar in an upward direction freely through the centralized hole, and simultaneously pulling up the cone and driving pin thereby causing the swinging members to expand from their resting position to a desired extension angle, thereby compacting the soil causing the casing to be securely installed in hole.

2. The system of claim 1, whereby the extension member is a hydraulic jack cylinder.

3. The system of claim 1, wherein the casing and the compaction bar are configured to cooperate with the extension member by having a dish that accommodates the length of the bar placed on top of the casing by sliding the dish down the length of the bar, said dish being larger in diameter than the casing, whereby the extension member in a closed configuration is lowered down the length of the bar until resting on top of the dish, whereby a securing member is used to secure the extension member.

4. A method for compacting soil in a hole comprising:

providing a terrapin configured for being removably inserted into the soil, said terrapin comprising a swing system and a compaction bar, the swing system being comprised of a base plate connected to a plurality of swinging members such that the swing members reversibly expand between a desired extension angle and a resting position while installed in the soil, said base plate having a centralized hole that accommodates the compaction bar allowing the compaction bar to move freely through, the compaction bar being comprised of a bar that is comprised of a top end and a bottom end, the bottom end being connected to a cone and a driving pin such that the cone sits above the driving pin and such that cone is in contact with the plurality of swinging members in their resting position;

placing a casing in the hole, inserting the terrapin by pushing the compaction bar through the casing such that the base plate, the plurality of swinging members, the cone and the driving pin are under the casing and the driving pin is contacting a bottom of the hole while a length of the bar to the top end remains above the casing, the casing and the compaction bar being configured to cooperate with an extension member;

placing the extension member in a closed configuration until on the topside of the casing;

activating the extension member causing the compaction bar to be pulled via the length of the bar in an upward direction freely through the centralized hole, while simultaneously pulling up the cone and driving pin thereby causing the swinging members to expand from their resting position to a desired angle, thereby compacting the soil in the hole causing the casing to be securely installed in the hole.

5. The method of claim 4, further comprising placing a dish that accommodates the length of the bar on topside of the casing, placing the extension member in a closed configuration on topside of the dish and using a securing member to secure the extension member, said dish being larger in diameter than the casing.

* * * * *